US009578898B2

(12) United States Patent
Liu

(10) Patent No.: US 9,578,898 B2
(45) Date of Patent: Feb. 28, 2017

(54) ELECTRONIC CIGARETTE AND ITS ATOMIZER

(75) Inventor: Qiuming Liu, Shenzhen (CN)

(73) Assignee: HUIZHOU KIMREE TECHNOLOGY CO., LTD., SHENZHEN BRANCH, Shenzhen, Guangdong Province (CN)

( * ) Notice: Subject to any disclaimer, the term of this patent is extended or adjusted under 35 U.S.C. 154(b) by 1145 days.

(21) Appl. No.: 13/521,053

(22) PCT Filed: Jun. 4, 2012

(86) PCT No.: PCT/CN2012/076451

§ 371 (c)(1),
(2), (4) Date: Jul. 9, 2012

(87) PCT Pub. No.: WO2013/181788

PCT Pub. Date: Dec. 12, 2013

(65) Prior Publication Data

US 2013/0319436 A1 Dec. 5, 2013

(51) Int. Cl.
*A24F 47/00* (2006.01)

(52) U.S. Cl.
CPC ..... *A24F 47/008* (2013.01)

(58) Field of Classification Search
None
See application file for complete search history.

(56) References Cited

U.S. PATENT DOCUMENTS

2009/0095311 A1* 4/2009 Han ..... A24F 47/008 131/194
2011/0303231 A1* 12/2011 Li ..... A24F 47/008 131/329

FOREIGN PATENT DOCUMENTS

JP 3164992 U * 12/2010 ..... A24F 47/00

* cited by examiner

*Primary Examiner* — Michael J Felton
(74) *Attorney, Agent, or Firm* — Cheng-Ju Chiang

(57) ABSTRACT

This invention involves an electronic cigarette atomizer, including an oil-guiding element and a heating wire wound around the oil-guiding element; the oil-guiding element is a strip of fiber textile, which is derived from fibers via weaving and glue-removing processes. The invention further provides an electronic cigarette, including an atomizer, a nozzle at one end of the atomizer and a battery assembly at the other end thereof, the atomizer including the oil-guiding element and heating wire around it, the oil-guiding element being a strip of fiber textile, being derived from fibers via weaving and glue-removing process. The oil-guiding element of the invention is the strip of fiber textile via weaving and glue-putting process, the fibers are closely combined which effectively avoids loosened slim fibers inhaled into the human body, is more helpful to users' health; moreover the fiber textile has a heat-resistance up to 400 degrees Celsius, and better security.

6 Claims, 2 Drawing Sheets

ELECTRONIC CIGARETTE AND ITS ATOMIZER

CROSS REFERENCE TO RELATED APPLICATIONS

The present application is a 35 U.S.C. §371 National Phase conversion of International (PCT) Patent Application No. PCT/CN2012/076451, filed on Jun. 4, 2012, the disclosure of which is incorporated by reference herein. The PCT International Patent Application was filed in Chinese.

TECHNICAL FIELD

This invention relates to an electronic simulation cigarette, in particular, refers to an electronic cigarette and its atomizer.

DESCRIPTION OF BACKGROUND

The existing electronic cigarette usually includes an atomizer, an oil reservoir, and a nozzle and a battery assembly respectively connected to two ends of the atomizer. Among this, the atomizer comprises an atomizing tube, an oil-guiding element configured within the atomizing tube, and a heating wire wound around the oil-guiding element, while the oil storage element can be configured within the nozzle or the atomizing tube.

Commonly used oil-guiding elements are glass fiber bundles or other fiber bundles, since the used fiber bundles have not been effectively fastened and thus are easy to loose, in the use of the electronic cigarettes, small fibers are easy to be inhaled into the human body, and thus adversely affect the health of the human body. In addition, the existing fiber bundles usually only resist a temperature of no higher than 200 degrees Celsius, while the electronic cigarettes work, the heating wire is heated up easily to more than 200 degrees Celsius, so there are serious security risks.

SUMMARY

The technical problems can be solved by the present invention is: to provide an electronic cigarette atomizer, in order to effectively avoid the fibers from being inhaled into the human body, and be capable of improving the heat-resistance.

The technical problems can be solved by the present invention is: to provide an electronic cigarette, in order to effectively avoid the fibers from being inhaled in the human body, and be capable of improving the heat-resistance.

To solve the above technical problems, the present invention adopts the following technical solution: an electronic cigarette atomizer comprises an oil-guiding element and a heating wire wound around the oil-guiding element; the oil-guiding element is a strip of fiber textile, the fiber textile is derived from fibers by weaving and glue removing.

Furthermore, the atomizer further comprises a hollow tubular atomizing sleeve, the atomizing sleeve is configured therein with a hollow tubular oil-reserving cotton and a high-temperature cotton affixed onto an inner wall of the oil-reserving cotton, the oil-guiding element and the heating wire are configured within a cavity surrounded by the high-temperature cotton, both ends of the oil-guiding element are crimped on the high-temperature cotton, the cavity at one end thereof further has a fiberglass tube, a wire conductor connected to one end of the heating wire passes through the fiberglass tube and stretches out to be connected with a battery assembly.

Furthermore, the atomizer further comprises a hollow tubular atomizing sleeve, a fiberglass tube which is parallel to the atomizing sleeve is fixed in the atomizing sleeve, an oil-reserving cotton for reserving smoke oil is filled in an annular space between the fiberglass tube and the atomizing sleeve, the oil-guiding element and the heating wire are configured within the fiberglass tube, and two ends of the oil-guiding element respectively pass through the fiberglass tube to be connected to the oil-reserving cotton.

Furthermore, the atomizer further comprises a hollow tubular atomizing sleeve, an oil-absorbing foam is fixed in the atomizing sleeve, a cave is configured in an end of the oil-absorbing foam, a ceramic seat is installed in the cave, the heating wire wound around the oil-guiding element is fixed on the ceramic seat.

Furthermore, a combination of the oil-guiding element and the heating wire is configured to be parallel to an axial direction of the atomizing sleeve or the combination of the oil-guiding element and the heating wire is configured to be perpendicular to the axial direction of the atomizing sleeve.

Furthermore, the fibers are glass fibers.

Furthermore, the fiber textile has a heat-resistance up to 400 degrees Celsius.

On the other hand, the present invention further provides an electronic cigarette, comprising an atomizer, a nozzle configured at an end of the atomizer and a battery assembly configured at another end of the atomizer, the atomizer comprising an oil-guiding element and a heating wire wound around the oil-guiding element, the oil-guiding element being a strip of fiber textile, the fiber textile being derived from fibers by weaving and glue removing.

Furthermore, the atomizer further comprises a hollow tubular atomizing sleeve, the atomizing sleeve is configured therein with a hollow tubular oil-reserving cotton and a high-temperature cotton affixed onto an inner wall of the oil-reserving cotton, the oil-guiding element and the heating wire are configured within a cavity surrounded by the high-temperature cotton, both ends of the oil-guiding element are crimped on the high-temperature cotton, the cavity at one end thereof further has a fiberglass tube, a wire conductor connected to one end of the heating wire passes through the fiberglass tube and stretches out.

Furthermore, the atomizer further comprises a hollow tubular atomizing sleeve, a fiberglass tube which is parallel to the atomizing sleeve is fixed in the atomizing sleeve, an oil-reserving cotton for reserving smoke oil is filled in an annular space between the fiberglass tube and the atomizing sleeve, the oil-guiding element and the heating wire are configured within the fiberglass tube, and two ends of the oil-guiding element respectively pass through the fiberglass tube to be connected to the oil-reserving cotton.

Furthermore, an oil-reserving chamber is configured in the nozzle, the atomizer further comprises a hollow tubular atomizing sleeve, an oil-absorbing foam is fixed in the atomizing sleeve, a cave is configured in an end of the oil-absorbing foam which opposes to the oil-reserving chamber, a ceramic seat is installed in the cave, the heating wire wound around the oil-guiding element is fixed on the ceramic seat, the oil-reserving camber therein is configured with an oil-guiding cord, the oil guiding cord is connected with the fiber textile.

Furthermore, a combination of the oil-guiding element and the heating wire is configured to be parallel to an axial direction of the atomizing sleeve or the combination of the oil-guiding element and the heating wire is configured to be perpendicular to the axial direction of the atomizing sleeve.

Furthermore, the fibers are glass fibers.

Furthermore, the fiber textile has a heat-resistance up to 400 degrees Celsius.

The benefits of this invention is: since the oil-guiding element is the strip of fiber textile derived from fibers by weaving and glue putting, the fiber materials are closely combined together so as to effectively avoid inhaling loosened slim fibers into the human body, and be more conducive to users' health; moreover the used fiber textile has a heat-resistance up to 400 degrees Celsius, and better security.

The following is a further detailed description of the present invention in combination of drawings.

DETAILED DESCRIPTION OF THE EMBODIMENTS

It should be noted that various embodiments and characteristics of this application can be mutually combined if without conflict, the invention would be described in detail as follows in combination of drawings and specific embodiments of the present invention.

Figure 1:
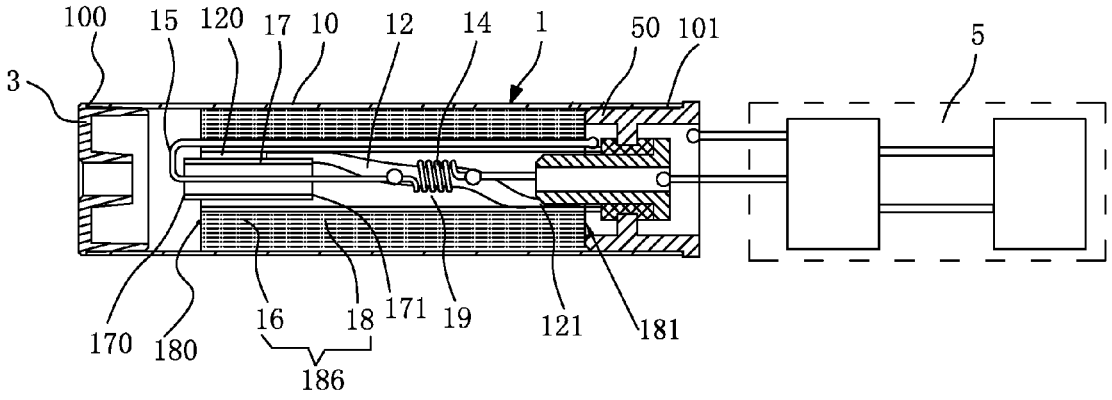
FIG. 1 is a cross-sectional view of an electronic cigarette according to a first embodiment of the present invention.

In the first embodiment of the present invention as shown in FIG. 1, the present invention provides an electronic cigarette and its atomizer, the electronic cigarette comprises an atomizer 1, a nozzle 3 and a battery assembly 5 respectively connected to opposite first and second ends 100, 101 of the atomizer 1.

The atomizer 1 comprises an atomizing sleeve 10, an oil-guiding element 12 and a heating wire 14 wound around the oil-guiding element 12.

The atomizing sleeve 10 is hollow tubular, the atomizing sleeve 10 is configured therein with a hollow tubular oil-reserving cotton 16 and a high temperature cotton 18 affixed onto an inner wall of the oil-reserving cotton 16, the oil-reserving cotton 16 and the high-temperature cotton 18 together form a hollow tubular structure 186 for storage of smoke oil with first and second ends 180, 181 open. The oil-guiding element 12 and the heating wire 14 are configured within a cavity 19 surrounded by the high-temperature cotton 18, both first and opposite second ends 120, 121 of the oil-guiding element 12 are respectively crimped and fixed on the high-temperature cotton 18 at the first and second ends 180, 181 of the structure 186 to draw the smoke oil from the oil-reserving cotton 16, in the cavity 19 at one first end 180 of the structure 186 is further set a fiberglass tube 17 with a first end 170 thereof extending upwards out from the first end 180 of the structure 186 and an opposite second end 171 thereof extending downwards above the heating wire 14, a wire conductor 15 connected to one first end of the heating wire 14 longitudinally passes through the fiberglass tube 17, stretches out from the first end 170 of the fiberglass tube 17, and reverse along the inner wall of the hollow tubular oil-reserving cotton 16 to be connected with a corresponding electrode 50 of the battery assembly 5 at the opposite second end 101 of the atomizer 1.

The oil-guiding element 12 is a strip of fiber textile, the fiber textile is derived from fiber materials such as glass fibers, cotton fibers etc. by weaving and glue removing, it is good in heat-resistance which is up to 400 degrees Celsius. Because the fiber materials as the raw materials by themselves are very slim and soft, and not conducive to weaving, for putting glue to the fibers before being weaved to enhance the fiber toughness in order to easily weave, the commonly used glues include: epoxy resin glue and so on. However, the presence of the glue can cause the textile with not high enough heat resistance, usually only 200 to 300 degrees Celsius, and the used glue of being heated or burning is easy to produce toxic substances which is harmful to health after being inhaled, therefore, after being weaved glue removing is implemented to remove the glue from the textile, specific implementation of glue removing may be to adopt chemical solvents that can dissolve the glue to deal with the textile so as to effectively remove the glue. It can be designed to have a variety of cross-sectional shapes, such as: round, rectangle, hexagon or circle. The heating wire 14 is wound around the oil-guiding element 12, a combination of the oil-guiding element 12 and the heating wire 14 is configured to be proximately parallel to an axial direction and longitudinally through the center of the atomizing sleeve 10. In another embodiment, the combination of the oil-guiding element 12 and the heating wire 14 can also be perpendicular to the axial direction of the atomizing sleeve 10.

In use of the electronic cigarette of the present invention, the smoke oil reserved in the oil-reserving cotton 16 is drawn out via the oil-guiding element 12, and atomized by heating of the heating wire 14 for users' inhalation. Since the oil-guiding element 12 is a strip of textile derived from fibers by weaving and glue putting, the fibers are hard to be loosened, so as to effectively avoid inhaling loosened slim fibers during smoking, and be more conducive to users' health.

Figure 2:
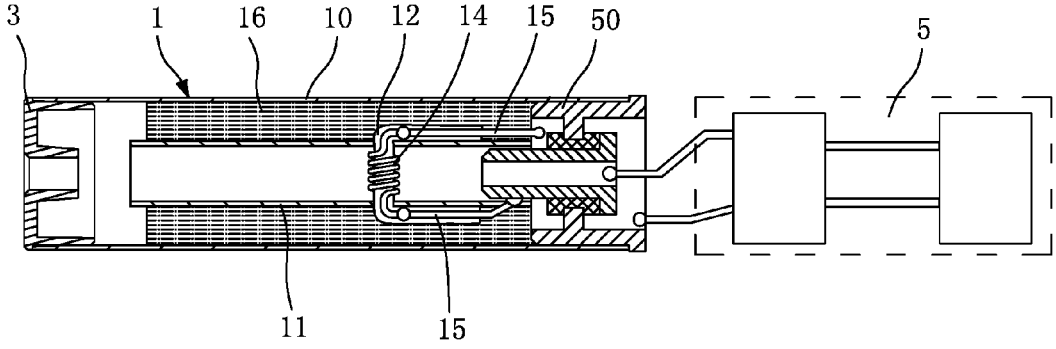
FIG. 2 is of a cross-sectional view of an electronic cigarette according to a second embodiment of the present invention.

In the second embodiment of the present invention as shown in FIG. 2, a fiberglass tube 11 parallel to the atomizing sleeve 10 is fixed in the atomizing sleeve 10, the oil-reserving cotton 16 is filled in an annular space between the fiberglass tube 11 and the atomizing sleeve 10, the oil-guiding element 12 and the heating wire 14 are configured within the fiberglass tube 11, and the two ends of the oil-guiding element 12 respectively pass through the fiberglass tube 11 to be connected to the oil-reserving cotton 16, while the wire conductors 15 respectively connected with the two ends of the heating wire 14 also pass through the fiberglass tube 11 to be connected to the corresponding electrodes 50 of the battery assembly; the combination of the oil-guiding element 12 and the heating wire 14 is configured to be perpendicular to the axial direction of the atomizing sleeve 10, understandably, the combination of the oil-guiding element 12 and the heating wire 14 can also be parallel to the axial direction of the atomizing sleeve 10.

Figure 3:
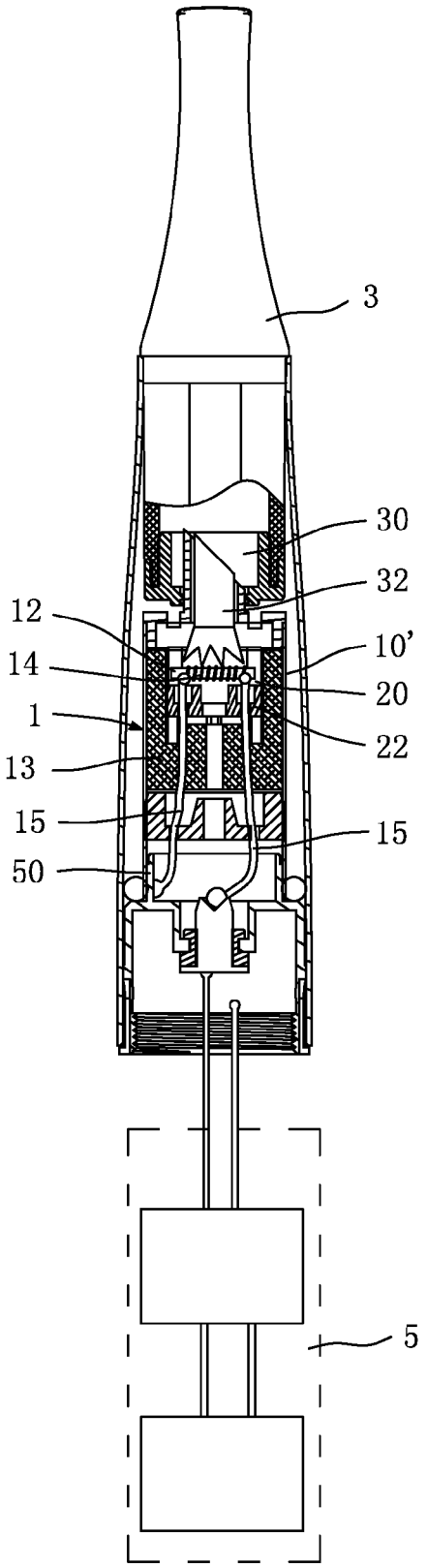
FIG. 3 of a cross-sectional view of an electronic cigarette according to a third embodiment of the present invention.

In the third embodiment of the present invention as shown in FIG. 3, an oil-reserving chamber 30 is configured in the nozzle 3, the atomizer 1 comprises a hollow tubular atomizing sleeve 10', an oil-absorbing foam 13, for example, nickel foam is fixed in the atomizing sleeve 10', a cave 20 is configured in an end of the oil-absorbing foam 13 which opposes to the oil-reserving chamber 30, a ceramic seat 22 is installed in the cave 20, the heating wire 14 wound around the oil-guiding element 12 is fixed on the ceramic seat 22, while the oil-reserving chamber 30 therein is configured with an oil-guiding cord 32, the oil-guiding cord 32 is connected with the fiber textile 12; the combination of the oil-guiding element 12 and the heating wire 14 is configured to be perpendicular to the axial direction of the atomizing sleeve 10', understandably, the combination of the oil-guiding element 12 and the heating wire 14 can also be parallel to the axial direction of the atomizing sleeve 10'.

Although embodiments of the present invention are shown and described above, for the persons of ordinary skill in this field, it can be understood that various changes, modifications, substitutes and variants to the embodiments within the spirit of the present invention can be made, and the scope of this invention is determined by the appended claims and their equivalents.

What is claimed is:

1. An electronic cigarette, comprising an atomizer, a nozzle configured at a first end of the atomizer, and a battery assembly with an electrode thereof configured at an opposite second end of the atomizer, the atomizer comprising:

a hollow tubular atomizing sleeve;

an oil-guiding element and a heating wire wound around the oil-guiding element;

a hollow tubular oil-reserving cotton configured in the atomizing sleeve;

a high temperature cotton affixed onto an inner wall of the oil-reserving cotton;

a cavity surrounded by the high-temperature cotton; and a fiberglass tube set in the cavity;

wherein the oil-reserving cotton and the high-temperature cotton together form a hollow tubular structure for storage of smoke oil with both first and second ends thereof open and defining the cavity longitudinally therethrough, the first open end of the structure of storage of smoke oil faces the first end of the atomizer, and the second open end of the structure of storage of smoke oil faces the second end of the atomizer;

a combination of the oil-guiding element and the heating wire is configured to be parallel to an axial direction of the atomizing sleeve within the cavity; both first and second ends of the oil-guiding element are respectively crimped and fixed on an inner wall of the high-temperature cotton at the first and second ends of the structure for storage of smoke oil to draw the smoke oil from the oil-reserving cotton;

the fiberglass tube is set in and fitted with the inner wall of the high-temperature cotton at the first end of the structure for storage of smoke oil, a first end of the fiberglass tube extends upwards out from the first end of the structure for storage of smoke oil and a second end of the fiberglass tube extends downwards above the heating wire; and the oil-guiding element is a strip of fiber textile longitudinally through the cavity, the fiber textile is derived from fibers in turn by glue putting, weaving and glue removing.

2. The electronic cigarette as described in claim 1, wherein a wire conductor is connected to a first end of the heating wire and longitudinally passes through the fiberglass tube, stretches out from the first end of the fiberglass tube, and longitudinally reverse along the inner wall of the high-temperature cotton and back to connect the electrode of the battery assembly at the second end of the atomizer.

3. The electronic cigarette as described in claim 1, wherein an oil-reserving chamber is configured in the nozzle, the atomizer further comprises a hollow tubular atomizing sleeve, an oil-absorbing foam is fixed in the atomizing sleeve, a cave is configured in an end of the oil-absorbing foam which opposes to the oil-reserving chamber, a ceramic seat is installed in the cave, the heating wire wound around the oil-guiding element is fixed on the ceramic seat, the oil-reserving camber therein is configured with an oil-guiding cord, the oil guiding cord is connected with the fiber textile.

4. The electronic cigarette as described in claim 1, wherein the fibers are glass fibers.

5. The electronic cigarette as described in claim 1, wherein the fiber textile has a heat-resistance up to 400 degrees Celsius.

6. The electronic cigarette as described in claim 3, wherein a combination of the oil-guiding element and the heating wire is configured to be parallel to an axial direction of the atomizing sleeve or the combination of the oil-guiding element and the heating wire is configured to be perpendicular to the axial direction of the atomizing sleeve.

* * * * *